US006106438A

United States Patent [19]

Dean

[11] Patent Number: 6,106,438

[45] Date of Patent: Aug. 22, 2000

[54] BI-DIRECTIONAL TORSION SPRING WRIST HAND AND FOREARM EXERCISER

[76] Inventor: C. David Dean, 5447 Lymbar, Houston, Tex. 77096

[21] Appl. No.: 09/246,874

[22] Filed: Feb. 8, 1999

[51] Int. Cl.[7] ..... A63B 23/12

[52] U.S. Cl. ..... 482/44; 127/45

[58] Field of Search ..... 482/44, 45, 121, 482/122, 127

[56] References Cited

U.S. PATENT DOCUMENTS

| | | | |
|---|---|---|---|
| 192,338 | 6/1877 | Marshall | 482/45 |
| 3,069,161 | 12/1962 | Melchiona . | |
| 3,510,130 | 5/1970 | Ferdinand | 482/45 |
| 3,708,164 | 1/1973 | Griffin . | |
| 3,717,338 | 2/1973 | Hughes . | |
| 4,095,789 | 6/1978 | Mueller . | |
| 4,155,547 | 5/1979 | Savio et al. . | |
| 4,428,577 | 1/1984 | Weingardt | 482/122 |
| 4,591,151 | 5/1986 | Hensley . | |
| 4,643,417 | 2/1987 | Nieman . | |
| 5,046,727 | 9/1991 | Wilkinson et al. . | |
| 5,690,598 | 11/1997 | Liang | 482/127 |
| 5,776,034 | 11/1997 | Stamler . | |
| 5,788,617 | 8/1998 | Paris | 482/112 |
| 5,830,110 | 11/1998 | Fielding | 482/44 |
| 5,897,469 | 4/1999 | Yalch | 482/121 |
| 5,941,799 | 8/1999 | Bergdorf | 482/44 |

*Primary Examiner*—Jerome Donnelly
*Attorney, Agent, or Firm*—Kenneth A. Roddy

[57] ABSTRACT

A hand-held bidirectional torsion spring wrist, hand and forearm exercise device has a pair of handgrip members rotatably joined together to rotate relative to each other in opposed directions about a common longitudinal axis, each sized and shaped to be gripped by a separate hand of a user to impart rotation thereof. An elongate flat rectangular spring member is disposed in the center of the handgrip members and has opposed ends secured to each handgrip member, respectively, and has a longitudinal axis coaxial with the common axis of the handgrip members. The spring member is subjected to a twisting torque force along its longitudinal axis upon relative rotation of the handgrip members in opposed directions to produce a resistive force against relative rotation of the handgrip members in opposed directions.

7 Claims, 6 Drawing Sheets

BI-DIRECTIONAL TORSION SPRING WRIST HAND AND FOREARM EXERCISER

BACKGROUND OF THE INVENTION

1. Field of the Invention

This invention relates generally to hand-held wrist, hand and forearm exercisers, and more particularly to a bi-directional torsion spring wrist, hand and forearm exerciser having a flat torsion spring centrally disposed within a pair of handgrip members that rotate relative to each other in opposed directions about a common longitudinal axis to subject it to a twisting torque force along its longitudinal axis and thereby produce resistance to relative rotation of the handgrip members.

2. Brief Description of the Prior Art

Hand-held wrist, hand and forearm exersize devices are known in the art. There are several patents which disclose wrist, hand and forearm exersize devices of various construction.

U.S. Pat. Nos. 3,717,338 issued to Hughes, U.S. Pat. No. 4,643,417 issued to Nieman, U.S. Pat. No. 4,046,727 issued to Wilkinson, and U.S. Pat. No. 5,776,034 issued to Stamler disclose hand-held wrist, hand and forearm exersise devices that utilize one or a pair of internal springs that function to apply an adjustable amount of pressure to a friction disk sandwiched between two opposed handgrips or to a pair of friction pads disposed at each end of the handgrips. The force resisting relative rotation between the handgrip members is produced by the frictional engagement of the disk or disks.

U.S. Pat. No. 4,095,789 issued to Mueller, and U.S. Pat. No. 4,591,151 issued to Hensley, disclose hand-held wrist, hand and forearm exercise devices that utilize one or a pair of coiled torsion spring members having opposed ends secured to opposed rotatable handgrips. These types of tension spring devices produce a different resistance force depending upon whether the rotation is tending to coil the spring tighter or to uncoil the spring.

U.S. Pat. No. 5,690,598 issued to Liang discloses a hand-held wrist, hand and forearm exercise device which utilizes a single compression spring sandwiched between two opposed handgrips which can be threadedly rotated toward or away from each other. The force resisting relative rotation between the handgrip members is produced by the outwardly biased spring engagement of the spring between the opposed handgrips, and the spring produces a greater biasing force when the handgrips are threaded toward each other and a smaller biasing force when threaded away from each other.

U.S. Pat. No. 4,155,547 issued to Savio et al discloses an exercise device for strengthening the wrist, forearm and elbow that utilizes two flat spring members disposed inside a pair of opposed handgrips. The flat spring members are disposed in parallel spaced relation laterally outward from the central longitudinal axis of the handgrips and are fixed at one end to one handgrip and their free ends extend through slots in a disk that is adjustably positioned along their length to vary their effective length. As described in detail hereinafter, the the parallel spaced apart springs of the Savio et al device do not actually twist about their longitudinal axis, but instead, tend to "revolve" about the central longitudinal axis of the device. Thus, the springs are subject to a bending force along their length which is in a lateral direction transverse to their width, rather than a torque force tending to twist them along their longitudinal axis.

The present invention is distinguished over the prior art in general, and these patents in particular by a hand-held bi-directional torsion spring wrist, hand and forearm exercise device having a pair of handgrip members rotatably joined together to rotate relative to each other in opposed directions about a common longitudinal axis, each sized and shaped to be gripped by a separate hand of a user to impart rotation thereof. An elongate flat rectangular spring member is disposed in the center of the handgrip members and has opposed ends secured to each handgrip member, respectively, and has a longitudinal axis coaxial with the common axis of the handgrip members. The spring member is subjected to a twisting torque force along its longitudinal axis upon relative rotation of the handgrip members in opposed directions to produce a resistive force against relative rotation of the handgrip members in opposed directions.

SUMMARY OF THE INVENTION

It is therefore an object of the present invention to provide a hand-held exercise device that will effectively exercise and strengthen the wrists, hands and forearms of the user.

It is another object of this invention to provide a hand-held wrist, hand and forearm exerciser that utilizes a rectangular torsion spring that subjected to a twisting torque force along its longitudinal axis upon relative rotation of handgrip members in opposed directions to produce a resistive force.

Another object of this invention is to provide a bi-directional wrist, hand and forearm exerciser which will produce the same resistive force when the handgrips are rotated relative to each other in one direction and in the reverse direction.

A further object of this invention is to provide a hand-held wrist, hand and forearm exerciser that does not require adjustment prior to use.

A still further object of this invention is to provide a wrist, hand and forearm exercise device which is simple in construction, inexpensive to manufacture, and rugged and reliable in operation.

Other objects of the invention will become apparent from time to time throughout the specification and claims as hereinafter related.

The above noted objects and other objects of the invention are accomplished by a hand-held bi-directional torsion spring wrist, hand and forearm exercise device having a pair of handgrip members rotatably joined together to rotate relative to each other in opposed directions about a common longitudinal axis, each sized and shaped to be gripped by a separate hand of a user to impart rotation thereof. An elongate flat rectangular spring member is disposed in the center of the handgrip members and has opposed ends secured to each handgrip member, respectively, and has a longitudinal axis coaxial with the common axis of the handgrip members. The spring member is subjected to a twisting torque force along its longitudinal axis upon relative rotation of the handgrip members in opposed directions to produce a resistive force against relative rotation of the handgrip members in opposed directions.

DESCRIPTION OF THE PREFERRED EMBODIMENT

Figure 1:
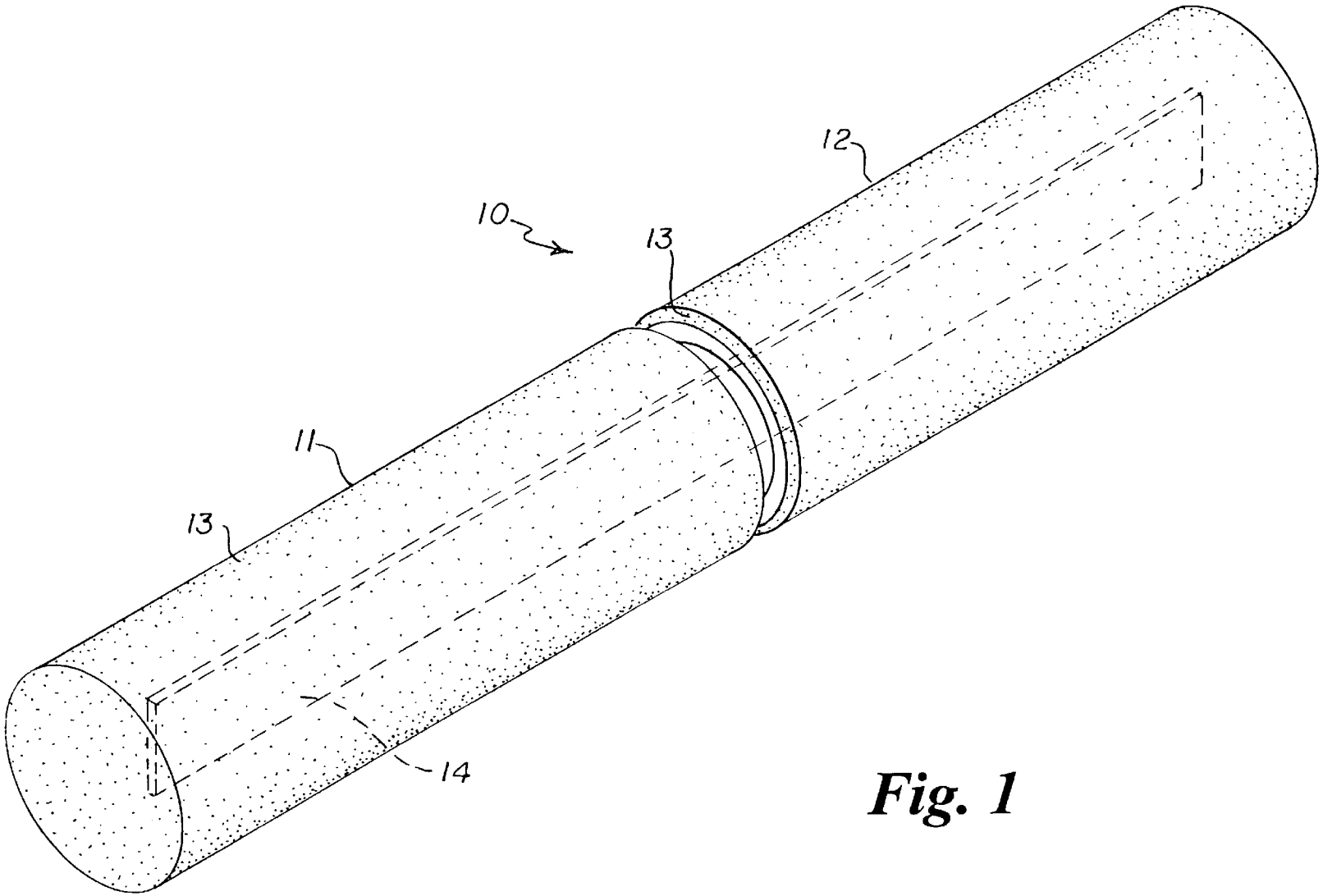
FIG. 1 is a perspective view of a bi-directional wrist, hand and forearm exerciser in accordance with the present invention.

Referring to the drawings by numerals of reference, there is shown in FIGS. 1, 2, 3, and 4, a bi-directional wrist, hand and forearm exerciser 10 in accordance with the present invention. The wrist, hand and forearm exerciser 10 is an elongate, generally tubular device approximately 9" to 10" in length and approximately 1" to 1½" in diameter.

The wrist, hand and forearm exerciser 10 has a first tubular handgrip member 11 and a second tubular handgrip member 12 joined together to rotate relative to one another about a common longitudinal axis. In a preferred embodiment, the handgrip members 11 and 12 are formed of a rigid plastic material, and are preferably provided with an exterior rubber layer 13 to provide a soft comfortable gripping surface and prevent then from slipping in the user's hands.

An elongate thin rectangular flat spring 14 is secured at each end inside the center of the the first and second handgrip members 11 and 12. In a preferred embodiment, the flat spring 14 is formed of tempered steel and is approximately ½" to ¾ wide and approximately 1/16" thick.

In the following discussion, several alternative methods of connecting the handgrip members for relative rotation and securing the opposed ends of the flat spring in the handgrip members will described.

Figure 2:
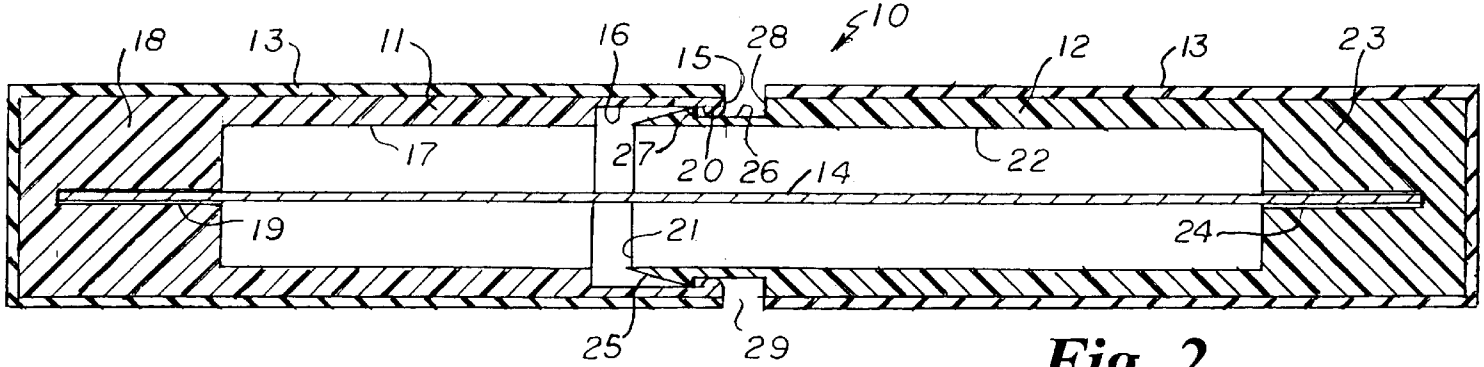
FIG. 2 is a longitudinal cross section through the wrist, hand and forearm exerciser taken along line 2—2 of FIG. 1 showing the spring from the top.
Figure 3:
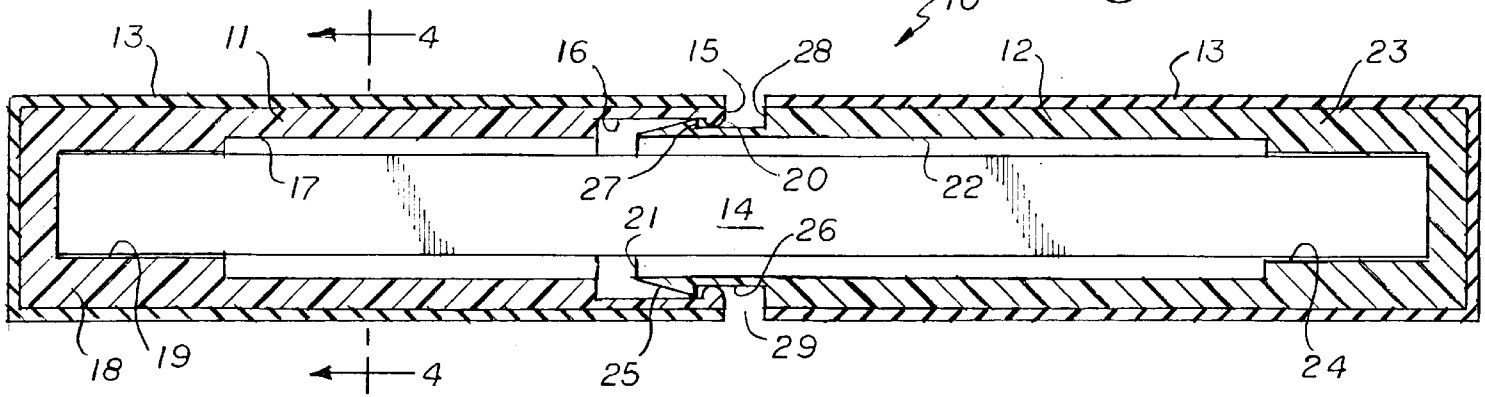
FIG. 3 is a longitudinal cross section through the wrist, hand and forearm exerciser showing the spring from the side.
Figure 4:
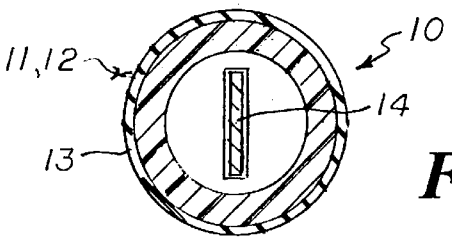
FIG. 4 is a transverse cross section through the wrist, hand and forearm exerciser taken along line 4—4 of FIG. 3.

FIGS. 2, 3, and 4 illustrate a preferred embodiment wherein the handgrip members 11 and 12 are connected together by a snap fit arrangement to rotate relative to each other. In this embodiment the first tubular handgrip member 11 has an open front end 15 with a counterbore 16 extending inwardly a distance from the open end and a central bore 17 extending inwardly from the counterbore terminating a distance therefrom to define a relatively short solid rear portion 18 enclosing the rear end of the handgrip member. A central thin rectangular slot 19 extends a distance into the solid rear portion 18. A rounded lip or bead 20 surrounds the open end of the first handgrip member.

The second tubular handgrip member 12 has an open front end 21 with a central bore 22 extending inwardly from the open front end and terminating a distance therefrom to define a relatively short solid rear portion 23 enclosing the rear end of the handgrip member. A central thin rectangular slot 24 extends a distance into the solid rear portion 23. The exterior of the forward end of the second tubular handgrip member 12 has an outwardly and rearwardly tapered conical nose portion 25 at its front end and a reduced diameter neck portion 26 extending a short distance rearwardly therefrom to define a radial shoulder 27 at the back end of the conical nose portion and a radial shoulder 28 spaced a distance therefrom.

The outer diameter of the conical nose portion 25 is slightly larger than the inside diameter of the bead 20 and the reduced diameter neck portion 26 of the second tubular handgrip member 12 is smaller in diameter than the diameter of the bead. When the handgrip members 11 and 12 are aligned axially and the conical nose portion 25 is pressed against the bead 20 with sufficient force to pass therethrough, it will snap fit into the counterbore 16 of the first handgrip member 11 such that it is telescopically and rotatably received in the counterbore inwardly of the bead 20 at the open end of the first tubular handgrip member. The conical nose portion 25 may be optionally provided with several circumferentially spaced slots to provide additional flexibility to facilitate radial contraction and expansion for the snap fit, depending upon the material of construction.

Prior to connecting the first and second handgrip members 11 and 12, the handgrips are positioned at opposed ends of the thin rectangular flat spring 14 with the ends of the spring received partially within the opposed slots 19 and 24. Then the front ends of the handgrip members 11 and 12 are pressed together to become connected by the snap fit arrangement, the opposed ends of the flat spring 14 are captured in the slots 19 and 24. The radial shoulder 27 will engage the bead 20 to prevent the handgrip members from being pulled apart.

When the handgrip members 11 and 12 are assembled with the spring 14 inside, the longitudinal axis of the spring is coaxial with the longitudinal axis of the assembled handgrip members 11 and 12 and there is a gap 29 between the front end 15 of the first tubular handgrip member 11 and the radial shoulder 28 of the second tubular handgrip member 12. The gap 29 allows the handgrip members to travel a short distance toward each other since the overall length of the device will tend to contract slightly as the handgrip members are twisted.

Figure 5:
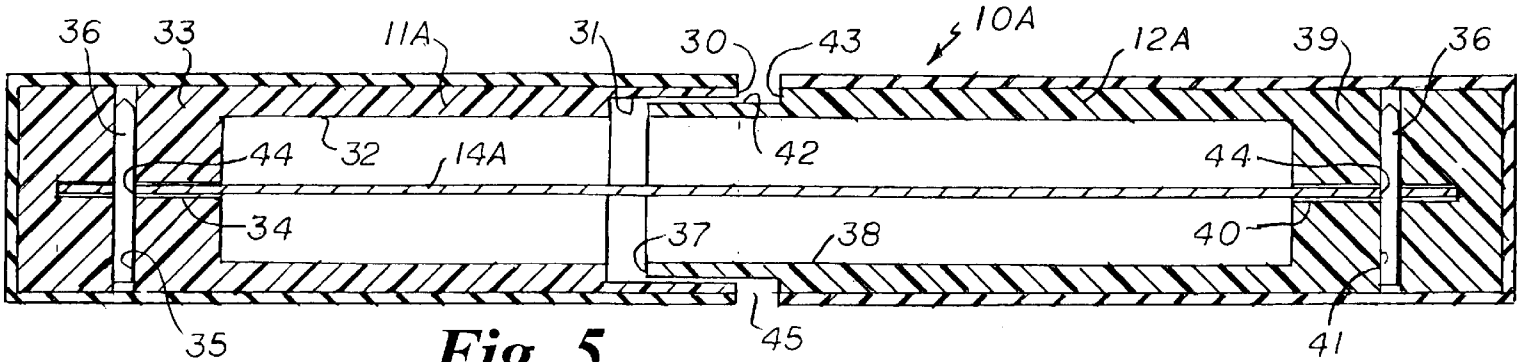
FIG. 5 is a longitudinal cross section through the wrist, hand and forearm exerciser having a spring pinned in the rear portions of the handgrip members.
Figure 6:
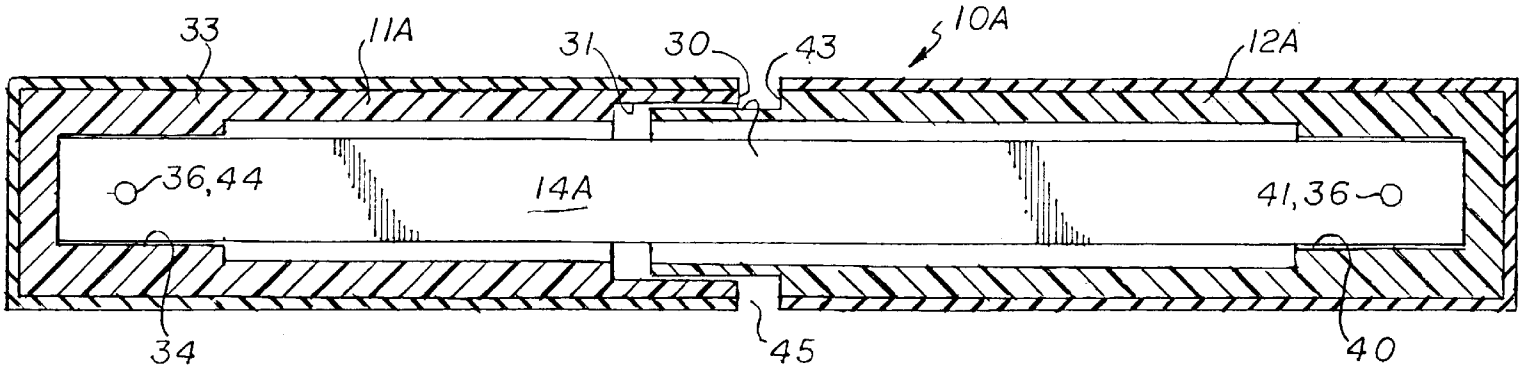
FIG. 6 is a longitudinal cross section through the wrist, hand and forearm exerciser of FIG. 5, showing the pinned spring from the side.

FIGS. 5 and 6 illustrate an alternate embodiment 10A wherein the handgrip members 11A and 12A are connected together to rotate relative to each other and the ends of the spring 14A are pinned into the handgrip members. The first tubular handgrip member 11A has an open front end 30 with a counterbore 31 extending inwardly a distance from the open end and a central bore 32 extending inwardly from the counterbore terminating a distance therefrom to define a relatively short solid rear portion 33 enclosing the rear end of the handgrip member. A central thin rectangular slot 34 extends a distance into the solid rear portion 33. A small diameter bore 35 extends transversly across the slot 34 to receive a lock pin 36.

The second tubular handgrip member 12A has an open front end 37 with a central bore 38 extending inwardly from the front end and terminating a distance therefrom to define a relatively short solid rear portion 39 enclosing the rear end of the handgrip member. A central thin rectangular slot 40 extends a distance into the solid rear portion 39. A small diameter bore 41 extends transversly across the slot 34 to receive a lock pin 36. The exterior of the forward end of the second tubular handgrip member 12A has a reduced diameter neck portion 42 extending a distance rearwardly from the front end terminating in a radial shoulder 43.

The neck portion 42 of the second tubular handgrip member 12A is smaller in diameter than the diameter of the counterbore 31 of the first tubular handgrip member 11A and is telescopically and rotatably received in the open end of the first tubular handgrip member.

A hole 44 extends through elongate thin rectangular flat spring 14A near each of its outer ends. The spring 14A is secured in the respective slots 34 and 40 in the rear portions 33 and 39 of the handgrip members 11A and 12A by pressing the lock pins 36 through the small diameter transverse bores 35 and 41 and the holes 44 in the spring 14, as shown in FIG. 5.

When the handgrip members 11A and 12A are assembled with the spring 14A inside, the longitudinal axis of the spring is coaxial with the longitudinal axis of the assembled handgrip members 11A and 12A and there is a gap 45 between the front end 30 of the first tubular handgrip member 11A and the radial shoulder 43 of the second tubular handgrip member 12A. The gap 45 allows the handgrip members to travel a short distance toward each other since the overall length of the device will tend to contract slightly as the handgrip members are twisted.

It should be understood that the spring may also be formed of other suitable stiff resilient materials that provide resistance to a twisting force along their longitudinal axis and resume their shape when the force is terminated.

Figure 7:
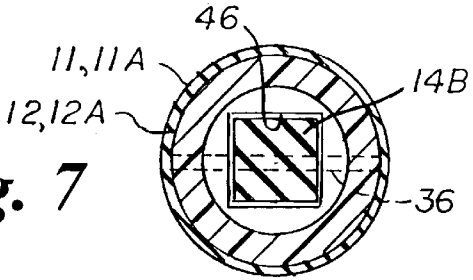
FIG. 7 is a transverse cross section through the wrist, hand and forearm exerciser having an alternate spring of square section.

For example, FIG. 7 shows, in transverse cross section, an elongate resilient member 14B formed of rubber or elastomeric material having a square cross section. In this modification, the rear ends of each handgrip member 11, 11A, 12, 12A are provided with a square slot 46 rather than the thin narrow slot.

This type of spring may be used in the handgrips that snap fit together as described above with reference to FIGS. 2–4, wherein the forward ends of the handgrip members 11 and 12 are provided with the bead and snap fit arrangement. It may also be used in the embodiment as described above with reference to FIGS. 5 and 6, wherein each of the opposed ends of the resilient member 14B are secured in the square slots 46 by lock pins 36 when the handgrips are connected.

OPERATION

To use the wrist, hand and forearm exerciser 10, 10A, the user grips the handgrip 11, 11A with one hand and the other handgrip 12, 12A with their other hand and rotates the handgrips in opposed directions about the longitudinal axis of the exerciser and the longitudinal axis of the spring. While still holding the same handgrips in the same hands, the user may rotate the handgrips first in one direction and then the reverse direction.

Figure 8:
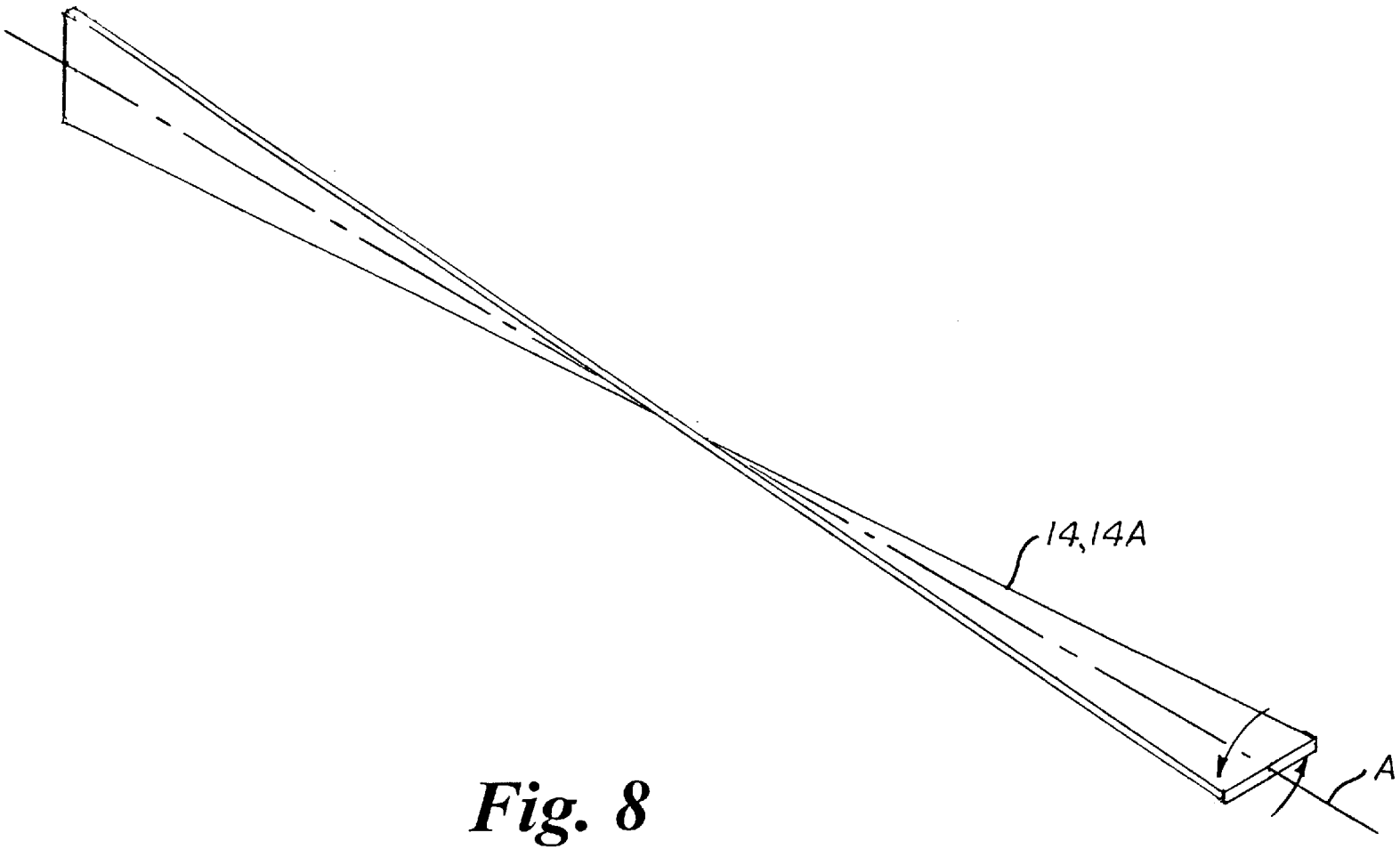
FIG. 8 is a schematic illustration of the present bi-directional wrist, hand and forearm exerciser, showing it in a twisted position.

As shown schematically in FIG. 8, the opposed twisting action of the handgrips tends to twist the opposed ends of the spring 14, 14A, and the spring offers resistance against the rotational torque force at its opposed ends which tends to twist the spring along its longitudinal axis "A".

Unlike prior art wrist, hand and forearm exercisers which utilize a single coiled spring, the resistance of the torque force of the flat spring of the present device is the same when the handgrips are rotated in one direction and then the reverse direction, hence, it is "bi-directional".

A coiled spring having opposed ends pinned to opposed rotating handgrips, on the other hand, would have a different resistance force depending upon whether the rotation is tending to coil the spring tighter or to uncoil the spring.

The action of the forces of the present invention is also different from prior art wrist, hand and forearm exercise devices that utilize a pair of parallel spaced apart flat springs secured in diametrically opposed relation and spaced radially outward a distance from a central longitudinal axis, such as that disclosed in U.S. Pat. No. 4,155,547 issued to Savio et al. Such a device is shown in FIGS. 9 and 10, and the action of the parallel spring device of Savio et al is shown schematically in FIGS. 10 and 11.

Figure 9:
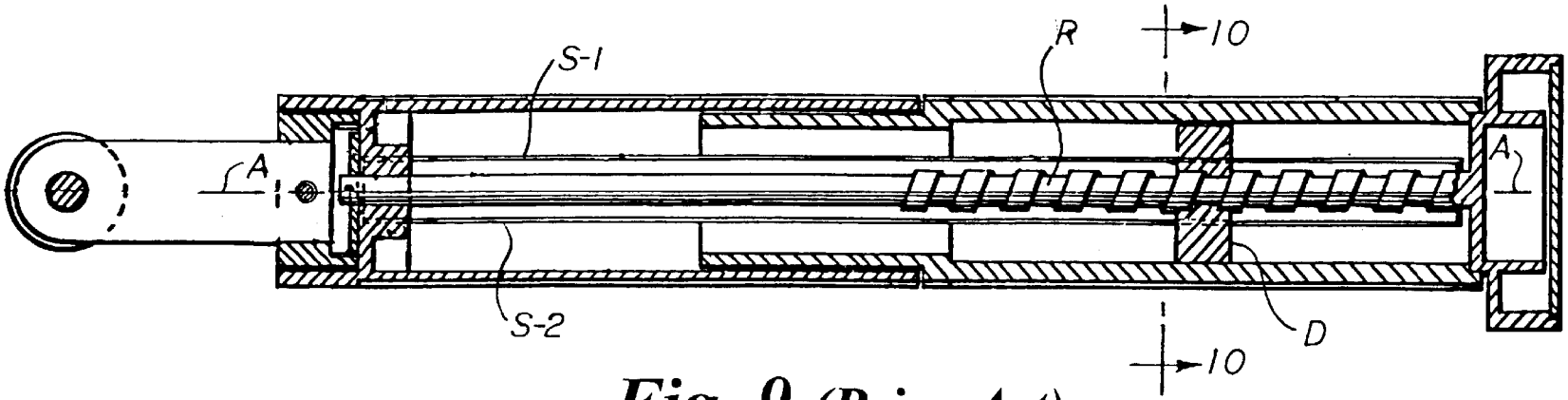
Fig. 9 (Prior Art)
FIG. 9 is a longitudinal cross section through a prior art wrist, hand and forearm exerciser having a pair of laterally spaced parallel flat spring members.
Figure 10:
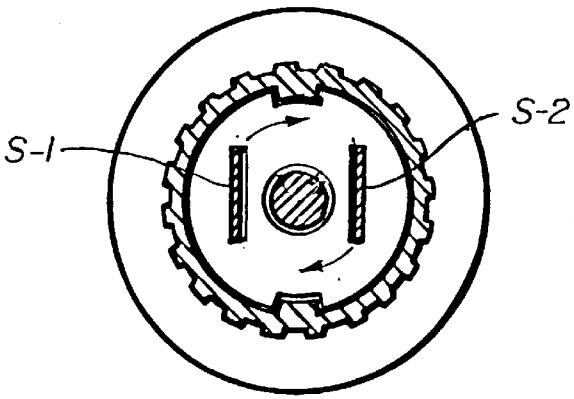
Fig. 10 (Prior Art)
FIG. 10 is a transverse cross section through the prior art wrist, hand and forearm exerciser taken along line 10—10 of FIG. 9.

As seen in FIGS. 9 and 10, this prior art device has a pair of parallel spaced apart flat springs S-1 and S-2 secured at one end in diametrically opposed relation and spaced radially outward a distance from a central longitudinal axis "A". A central adjustment rod R extends along the central axis "A" of the handgrips. The free ends of the springs S-1 and S-2 pass through slots in a flat disk D that is moved along the free ends of the springs by the rod R to vary their effective length.

Figure 11:
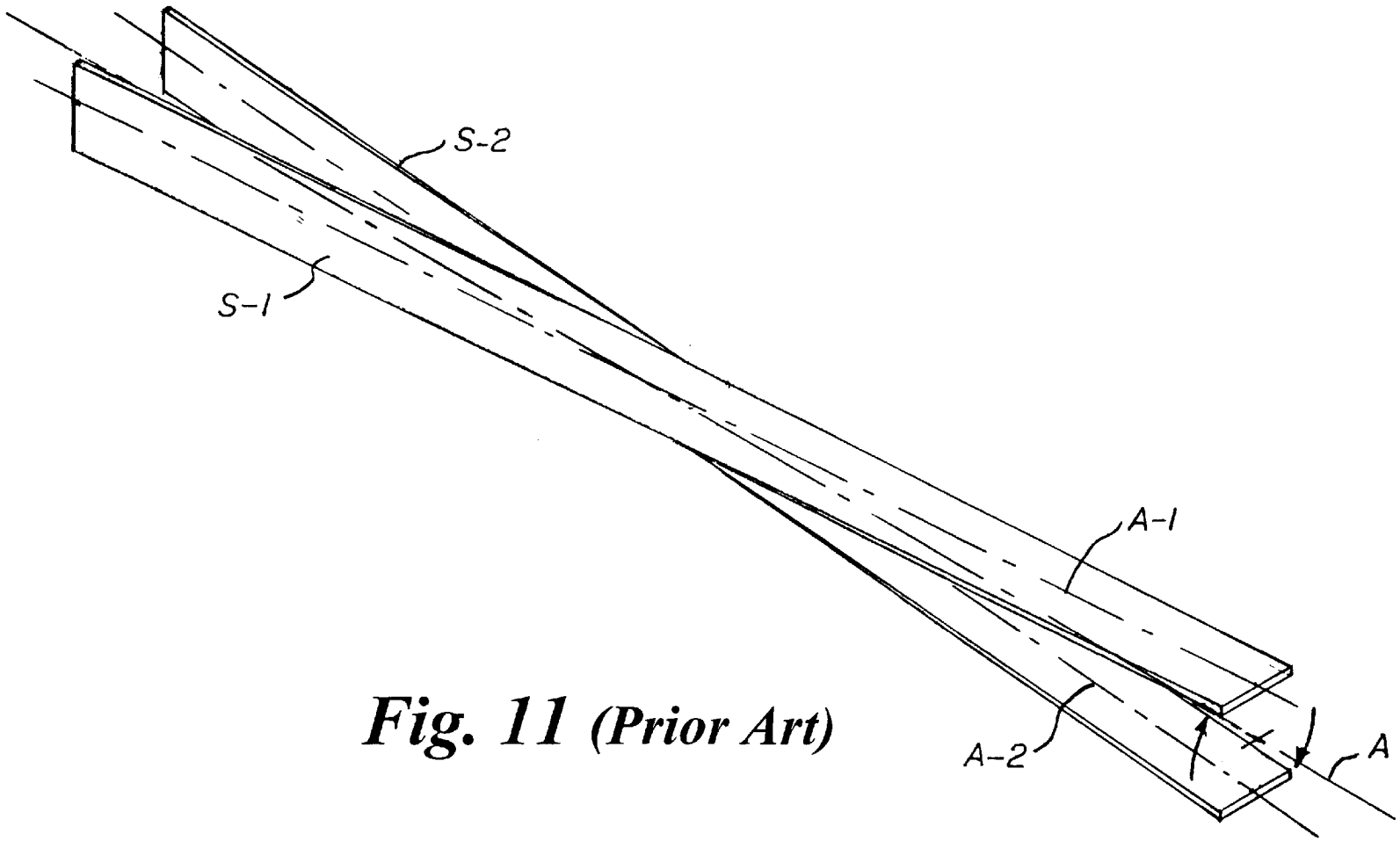
Fig. 11 (Prior Art)
FIG. 11 is a schematic illustration of the prior art exercise device of FIGS. 9 and 10 showing the action of the spring members.

As shown in FIG. 11, each spring S-1 and S-2 has a longitudinal axis "A-1" and "A-2", respectively. With the prior art device, when the ends of the handgrips are rotated in opposite directions about the central longitudinal axis "A", the parallel spaced apart springs S-1 and S-2 do not actually twist along their axis "A-1" and "A-2", but instead, tend to "revolve" about the central longitudinal axis "A" of the device. The springs would be incapable of twisting along their axis because they pass through the slots in the disk D. Thus, the springs S-1 and S-2 are subjected to a bending or shear force which is in a transverse direction across their width and transverse to their longitudinal axis "A-1" and "A-2", instead of a torque force along their length tending to twist them along their longitudinal axis.

While this invention has been described fully and completely with special emphasis upon a preferred embodiment, it should be understood that within the scope of the appended claims the invention may be practiced otherwise than as specifically described herein.

What is claimed is:

1. A hand-held bi-directional torsion spring wrist, hand and forearm exercise device, comprising:

a first tubular handgrip member having an open end with an annular raised shoulder on an inner surface thereof, a central longitudinal bore extending inwardly therefrom terminating in a solid end portion, and a generally rectangular longitudinal slot in said solid end portion;

a second tubular handgrip member having a reduced diameter neck portion surrounding an open end with a snap fit protuberance on an outer end thereof, a central longitudinal bore extending inwardly from its said open end terminating in a solid end portion, and a generally rectangular longitudinal slot in said solid end portion;

said snap fit protuberance rotatable engaged with said annular raised shoulder such that said first tubular handgrip member and said second handgrip member are rotatably and inseparably joined together to rotate relative to each other in opposed directions about a common longitudinal axis, and each said handgrip member sized and shaped to be gripped by a separate hand of a user to impart rotation thereof; and an elongate rectangular spring member disposed in the center of said handgrip members and having opposed ends each permanently engaged in said longitudinal slot in said solid portion of a respective said handgrip member when said first tubular handgrip member and said second handgrip member are rotatably and inseparably joined together, and having a longitudinal axis coaxial with said common longitudinal axis of said handgrip members;

said spring member being subjected to a twisting torque force along its longitudinal axis upon relative rotation of said handgrip members in opposed directions to produce a resistive force against relative rotation of said handgrip members in opposed directions.

2. The torsion spring wrist, hand and forearm exercise device according to claim 1, wherein said snap fit protuberance at the outer end of said reduced diameter neck portion of said second handgrip member comprises an outwardly and rearwardly tapered conical nose portion with an annular shoulder at a back end thereof, and said annular raised shoulder on the inner surface of said open end of said first tubular handgrip member comprises an annular bead;

said conical nose portion having an outer diameter greater than an inside diameter of said bead;

said opposed ends of said elongate rectangular spring member being permanently captured in said longitudinal slot in said solid portion of a respective said handgrip member when said first tubular handgrip member and said second handgrip member are rotatably and inseparably joined together; and said annular shoulder at said back end of said conical nose portion is engaged with said annular bead to prevent said first and second handgrip members from being pulled apart.

3. The torsion spring wrist, hand and forearm exercise device according to claim 1, wherein said elongate rectangular spring member is a thin flat rectangular strip of material having opposed ends; and said slot in each said solid end portion of said handgrip members is a central longitudinal thin rectangular slot therein for receiving a respective one of said opposed ends.

4. The torsion spring wrist, hand and forearm exercise device according to claim 1, wherein said elongate rectangular spring member is a rectangular strip of material of rectangular cross section having opposed ends; and said slot in each said solid end portion of said handgrip members is a central longitudinal slot therein of rectangular cross section for receiving a respective one of said opposed ends.

5. A hand-held bi-directional torsion spring wrist, hand and forearm exercise device, comprising:

a first tubular handgrip member having an open end, a central longitudinal bore extending inwardly therefrom terminating in a solid end portion, and a generally rectangular longitudinal slot in said solid end portion;

a second tubular handgrip member having a reduced diameter neck portion surrounding an open end, a central longitudinal bore extending inwardly from its said open end terminating in a solid end portion, and a generally rectangular longitudinal slot in said solid end portion:

said reduced diameter neck portion of said second handgrip member slidably received and rotatably engaged in said open end of said first handgrip member such that said first and second handgrip members to rotate relative to each other in opposed directions about a common longitudinal axis, and each said handgrip member sized and shaped to be gripped by a separate hand of a user to impart rotation thereof; and an elongate rectangular spring member disposed in the center of said handgrip members and having opposed ends and a longitudinal axis coaxial with said common longitudinal axis of said handgrip members;

a transverse aperture through each of said spring member opposed ends;

a transverse aperture extending through each said solid end portion and said longitudinal slot of said handgrip members; and a pin installed transversely through said solid end portion of each said handgrip member and said longitudinal slot therein, and through said transverse apertures in each said spring end to secure said spring member opposed ends to each said handgrip member, respectively; such that said first tubular handgrip member and said second handgrip member are rotatably and inseparably joined together by said spring member;

said spring member being subjected to a twisting torque force along its longitudinal axis upon relative rotation of said handgrip members in opposed directions to produce a resistive force against relative rotation of said handgrip members in opposed directions.

6. The torsion spring wrist, hand and forearm exercise device according to claim 5, wherein said elongate rectangular spring member is a thin flat rectangular strip of material having a transverse aperture through opposed ends; and said aperture in each said solid end portion of said handgrip members is a central longitudinal thin rectangular slot therein for receiving a respective one of said opposed ends.

7. The torsion spring wrist, hand and forearm exercise device according to claim 5, wherein said elongate rectangular spring member is a rectangular strip of material of rectangular cross section having opposed ends; and said aperture in each said solid end portion of said handgrip members is a central longitudinal rectangular slot therein of rectangular cross section for receiving a respective one of said opposed ends.

* * * * *